US011834725B2

(12) United States Patent
Matsuo et al.

(10) Patent No.: US 11,834,725 B2
(45) Date of Patent: Dec. 5, 2023

(54) MARTENSITIC STAINLESS STEEL MATERIAL

(71) Applicant: NIPPON STEEL CORPORATION, Tokyo (JP)

(72) Inventors: Daisuke Matsuo, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 479 days.

(21) Appl. No.: 16/973,231

(22) PCT Filed: Sep. 26, 2019

(86) PCT No.: PCT/JP2019/037770
§ 371 (c)(1),
(2) Date: Dec. 8, 2020

(87) PCT Pub. No.: WO2020/067247
PCT Pub. Date: Apr. 2, 2020

(65) Prior Publication Data

US 2021/0238705 A1 Aug. 5, 2021

(30) Foreign Application Priority Data

Sep. 27, 2018 (JP) ..... 2018-181109

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/004* (2013.01); *C21D 6/005* (2013.01);
(Continued)

(58) Field of Classification Search
CPC . C21D 9/46; C21D 1/18; C21D 6/004; C21D 6/005; C21D 6/007; C21D 6/008;
(Continued)

(56) References Cited

U.S. PATENT DOCUMENTS 5,820,699 A 10/1998 Asahi et al.
2005/0224143 A1 10/2005 Takabe et al.

FOREIGN PATENT DOCUMENTS

JP 8246107 A 9/1996
JP 10001755 A 1/1998
(Continued)

*Primary Examiner* — Anthony M Liang
*Assistant Examiner* — Danny N Kang
(74) *Attorney, Agent, or Firm* — Greer Burns & Crain Ltd.

(57) ABSTRACT

The martensitic stainless steel material has a chemical composition, which contains: in mass %, C: 0.030% or less, Si: 1.00% or less, Mn: 1.00% or less, P: 0.030% or less, S: 0.005% or less, Al: 0.010 to 0.100%, N: 0.0010 to 0.0100%, Ni: 5.00 to 6.50%, Cr: 10.00 to 13.40%, Cu: 1.80 to 3.50%, Mo: 1.00 to 4.00%, V: 0.01 to 1.00%, Ti: 0.050 to 0.300%, Co: 0.300% or less, Ca: 0.0006 to 0.0030%, and O: 0.0050% or less, and satisfies Formulae (1) and (2) in the description. An area of each intermetallic compound and each Cr oxide in the steel material is 5.0 $\mu m^2$ or less, a total area fraction of intermetallic compounds and Cr oxides is 3.0% or less, and a maximum circle-equivalent diameter of Ca oxide is 9.5 μm or less.

4 Claims, 1 Drawing Sheet

F1

(51) Int. Cl.

| | |
|---|---|
| ***C21D 6/00*** | (2006.01) |
| ***C21D 8/00*** | (2006.01) |
| ***C22C 38/00*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/52*** | (2006.01) |

(52) U.S. Cl.

CPC ..... *C21D 6/007* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/52* (2013.01); *C21D 2211/008* (2013.01)

(58) Field of Classification Search

CPC .. C21D 8/0205; C21D 8/0226; C21D 8/0263; C21D 2211/008; C21D 1/22; C21D 9/085; C21D 2211/004; C21D 1/25; C21D 8/105; C21D 9/14; C21D 9/08; C22C 38/001; C22C 38/002; C22C 38/02; C22C 38/04; C22C 38/06; C22C 38/42; C22C 38/44; C22C 38/46; C22C 38/50; C22C 38/52

See application file for complete search history.

(56) References Cited

FOREIGN PATENT DOCUMENTS

| | | | |
|---|---|---|---|
| JP | 10503809 | A | 4/1998 |
| JP | 10130785 | A | 5/1998 |
| JP | 11310855 | A | 11/1999 |
| JP | 2000192196 | A | 7/2000 |
| JP | 2003003243 | A | 1/2003 |
| JP | 2012136742 | A | 7/2012 |
| WO | 2004057050 | A1 | 7/2004 |

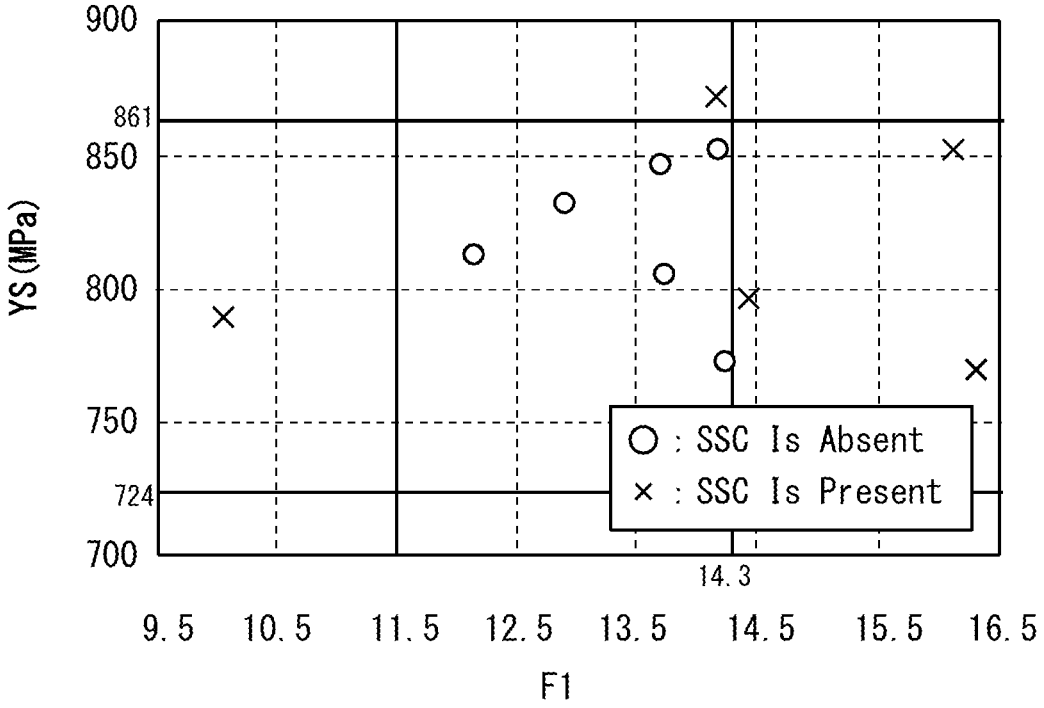
900
861
850
800
750
724
700
YS (MPa)
14.3
9.5
10.5
11.5
12.5
13.5
14.5
15.5
16.5
F1
○ : SSC Is Absent
× : SSC Is Present

MARTENSITIC STAINLESS STEEL MATERIAL

This is a National Phase Application filed under 35 U.S.C. § 371, of International Application No. PCT/JP2019/037770, filed Sep. 26, 2019, the contents of which are incorporated by reference.

TECHNICAL FIELD

The present invention relates to a steel material, and more particularly to a martensitic stainless steel material having a microstructure mainly composed of martensite.

BACKGROUND ART

As wells (oil wells and gas wells) with low corrosiveness have been exhausted, the development of wells with high corrosiveness has been promoted. A highly corrosive well is an environment containing large amounts of corrosive substances. Examples of corrosive substance include corrosive gasses such as hydrogen sulfide and carbon dioxide gas, and the like. In the present description, the environment of a highly corrosive well which contains hydrogen sulfide and carbon dioxide gas and in which a partial pressure of hydrogen sulfide is 0.1 atm or more is referred to as a "highly corrosive environment." The temperature of a highly corrosive environment is, though it depends on the depth of well, in a range from the normal temperature to about 200° C. The term "normal temperature" as used herein means 24±3° C.

It is known that chromium (Cr) is effective for improving the carbon-dioxide gas corrosion resistance of steel. Therefore, in an environment containing a large amount of carbon dioxide gas, martensitic stainless steels containing about 13 mass % of Cr (hereinafter, referred to as 13Cr steel), typified by API L80 13Cr Steel (normal 13Cr steel) and Super 13Cr Steel; duplex stainless steel in which the Cr content is higher than in 13Cr steel; and others are used depending on the partial pressure of carbon dioxide gas and temperature.

However, hydrogen sulfide causes sulfide stress cracking (hereinafter, referred to as SSC) in, for example, a steel material for oil country tubular goods made of 13Cr steel having a high strength of 724 MPa or more (105 ksi or more). A 13Cr steel, which has a high strength of 724 MPa or more, is more sensitive to SSC compared to a low alloy steel, and SSC will occur even at a relatively low partial pressure of hydrogen sulfide (for example, less than 0.1 atm). Therefore, 13Cr steel is not suitable for use in the highly corrosive environment containing hydrogen sulfide and carbon dioxide gas. On the other hand, the duplex stainless steel is more expensive than 13Cr steel. Accordingly, there is a need for a steel material for oil country tubular goods which has a high yield strength of 724 MPa or more and high SSC resistance and which can be used in highly corrosive environments.

Japanese Patent Application Publication No. 10-001755 (Patent Literature 1), National Publication of International Patent Application No. 10-503809 (Patent Literature 2), Japanese Patent Application Publication No. 2003-003243 (Patent Literature 3), International Application Publication No. 2004/057050 (Patent Literature 4), Japanese Patent Application Publication No. 2000-192196 (Patent Literature 5), Japanese Patent Application Publication No. 11-310855 (Patent Literature 6), Japanese Patent Application Publication No. 08-246107 (Patent Literature 7), and Japanese Patent Application Publication No. 2012-136742 (Patent Literature 8) propose martensitic stainless steels having excellent SSC resistance.

The chemical composition of the martensitic stainless steel according to Patent Literature 1 consists of: in mass %, C: 0.005 to 0.05%, Si: 0.05 to 0.5%, Mn: 0.1 to 1.0%, P: 0.025% or less, S: 0.015% or less, Cr: 10 to 15%, Ni: 4.0 to 9.0%, Cu: 0.5 to 3%, Mo: 1.0 to 3%, Al: 0.005 to 0.2%, and N: 0.005% to 0.1%, with the balance being Fe and unavoidable impurities. The chemical composition further satisfies $40C+34N+Ni+0.3Cu-1.1Cr-1.8Mo \geq -10$. The microstructure of the martensitic stainless steel is composed of a tempered martensite phase, a martensite phase, and a retained austenite phase. In the microstructure, a total fraction of the tempered martensite phase and the martensite phase is 60% or more and 80% or less, with the balance being the retained austenite phase.

The chemical composition of the martensitic stainless steel according to Patent Literature 2 consists of: in weight %, C: 0.005 to 0.05%, $Si \leq 0.50\%$, Mn: 0.1 to 1.0%, $P \leq 0.03\%$, $S \leq 0.005\%$, Mo: 1.0 to 3.0%, Cu: 1.0 to 4.0%, Ni: 5 to 8%, and $Al \leq 0.06\%$, with the balance being Fe and impurities, and further satisfies $Cr+1.61Mo \geq 13$ and $40C+34N+Ni+0.3Cu-1.1Cr-1.8Mo \geq -10.5$. The microstructure of the martensitic stainless steel of this literature is a tempered martensite structure.

The chemical composition of the martensitic stainless steel according to Patent Literature 3 consists of: in mass %, C: 0.001 to 0.04%, Si: 0.5% or less, Mn: 0.1 to 3.0%, P: 0.04% or less, S: 0.01% or less, Cr: 10 to 15%, Ni: 0.7 to 8%, Mo: 1.5 to 5.0%, Al: 0.001 to 0.10%, and N: 0.07% or less, with the balance being Fe and impurities. The chemical composition further satisfies $Mo \geq 1.5-0.89Si+32.2C$. The metallographic structure is mainly composed of tempered martensite, carbides which have precipitated during tempering, and Laves phase-based intermetallic compounds which have precipitated during tempering. The martensitic stainless steel of Patent Literature 3 has high strength of not less than 860 MPa of proof stress.

The chemical composition of the martensitic stainless steel according to Patent Literature 4 consists of in mass %, C: 0.005 to 0.04%, Si: 0.5% or less, Mn: 0.1 to 3.0%, P: 0.04% or less, S: 0.01% or less, Cr: 10 to 15%, Ni: 4.0 to 8%, Mo: 2.8 to 5.0%, Al: 0.001 to 0.10%, and N: 0.07% or less, with the balance being Fe and impurities. The chemical composition further satisfies $Mo \geq 2.3-0.89Si+32.2C$. The metallographic structure is mainly composed of tempered martensite, carbides which have precipitated during tempering, intermetallic compounds such as Laves phase and σ phase which have precipitated during tempering. The martensitic stainless steel of Patent Literature 4 has a high strength of 860 MPa proof stress or more.

The martensitic stainless steel according to Patent Literature 5 consists of: in weight %, C: 0.001 to 0.05%, Si: 0.05 to 1%, Mn: 0.05 to 2%, P: 0.025% or less, S: 0.01% or less, Cr: 9 to 14%, Mo: 3.1 to 7%, Ni: 1 to 8%, Co: 0.5 to 7%, sol. Al: 0.001 to 0.1%, N: 0.05% or less, O (oxygen): 0.01% or less, Cu: 0 to 5%, W: 0 to 5%, with the balance being Fe and impurities.

The martensitic stainless steel according to Patent Literature 6 contains C: 0.05% or less, and Cr: 7 to 15%. Further, Cu content in a solid-solution state is 0.25 to 5%.

The chemical composition of the martensitic stainless steel according to Patent Literature 7 consists of: in mass %, C: 0.005% to 0.05%, Si: 0.05% to 0.5%, Mn: 0.1% to 1.0%, P: 0.025% or less, S: 0.015% or less, Cr: 12 to 15%, Ni: 4.5% to 9.0%, Cu: 1% to 3%, Mo: 2% to 3%, W: 0.1% to 3%, Al: 0.005 to 0.2%, and N: 0.005% to 0.1%, with the balance being Fe and unavoidable impurities. The chemical composition further satisfies 40C+34N+Ni+0.3Cu+Co−1.1Cr−1.8Mo−0.9W≥−10.

The martensitic stainless seamless pipe according to Patent Literature 8 consists of: in mass %, C: 0.01% or less, Si: 0.5% or less, Mn: 0.1 to 2.0%, P: 0.03% or less, S: 0.005% or less, Cr: 14.0 to 15.5%, Ni: 5.5 to 7.0%, Mo: 2.0 to 3.5%, Cu: 0.3 to 3.5%, V: 0.20% or less, Al: 0.05% or less, and N: 0.06% or less, with the balance being Fe and unavoidable impurities. The martensitic stainless seamless pipe according to Patent Literature 8 has a yield strength of 655 to 862 MPa, and a yield ratio of 0.90 or more.

CITATION LIST

Patent Literature

Patent Literature 1: Japanese Patent Application Publication No. 10-001755
Patent Literature 2: National Publication of International Patent Application No. 10-503809
Patent Literature 3: Japanese Patent Application Publication No. 2003-003243
Patent Literature 4: International Application Publication No. 2004/057050
Patent Literature 5: Japanese Patent Application Publication No. 2000-192196
Patent Literature 6: Japanese Patent Application Publication No. 11-310855
Patent Literature 7: Japanese Patent Application Publication No. 08-246107
Patent Literature 8: Japanese Patent Application Publication No. 2012-136742

SUMMARY OF INVENTION

Technical Problem

For a martensitic stainless steel material, which has a yield strength of 724 MPa or more and has excellent SSC resistance in the highly corrosive environment, excellent hot workability is also required. One way of improving hot workability is containing Ca. Ca controls the morphology of inclusions, and suppresses occurrence of a crack originated from an inclusion during hot working. Further, Ca suppresses segregation of P in steel. Further, Ca immobilizes S as sulfide. Owing to these actions, Ca improves hot workability of steel material.

However, if Ca is contained in a martensitic stainless steel material having a yield strength of 724 MPa or more, although hot workability will be improved, SSC resistance may deteriorate.

It is an object of the present disclosure to provide a martensitic stainless steel material, which has a yield strength of 724 MPa or more, and can achieve both excellent SSC resistance in a highly corrosive environment and excellent hot workability, at the same time.

Solution to Problem

A martensitic stainless steel material according to the present disclosure, comprising a chemical composition consisting of: in mass %, C: 0.030% or less,
Si: 1.00% or less,
Mn: 1.00% or less,
P: 0.030% or less,
S: 0.005% or less,
Al: 0.010 to 0.100%,
N: 0.0010 to 0.0100%,
Ni: 5.00 to 6.50%,
Cr: 10.00 to 13.40%,
Cu: 1.80 to 3.50%,
Mo: 1.00 to 4.00%,
V: 0.01 to 1.00%,
Ti: 0.050 to 0.300%,
Co: 0.300% or less,
Ca: 0.0006 to 0.0030%,
O: 0.0050% or less, and
W: 0 to 1.50%, with the balance being Fe and impurities, and satisfying Formulae (1) and (2), wherein a yield strength is 724 to 861 MPa, a volume ratio of martensite is 80% or more in the microstructure, an area of each intermetallic compound and each Cr oxide in the steel material is 5.0 $\mu m^2$ or less, and a total area fraction of intermetallic compounds and Cr oxides is 3.0% or less, and a maximum circle-equivalent diameter of an oxide containing Ca is 9.5 μm or less in the steel material:

$$11.5 \leq Cr+2Mo+2Cu-1.5Ni \leq 14.3 \quad (1)$$

$$Ti/(C+N) \geq 6.4 \quad (2)$$

where, each symbol of element in Formulae (1) and (2) is substituted by the content (in mass %) of the corresponding element.

Advantageous Effects of Invention

The martensitic stainless steel material has a yield strength of 724 MPa or more, and can achieve both excellent SSC resistance in a highly corrosive environment and excellent hot workability at the same time.

BRIEF DESCRIPTION OF DRAWINGS

FIG. 1 is a diagram to show relation between "F1=Cr+2Mo+2Cu−1.5Ni", and yield strength YS (MPa) and SSC resistance.

DESCRIPTION OF EMBODIMENTS

The present inventors have conducted research and investigation on SSC resistance and hot workability of a martensitic stainless steel material having a yield strength of 724 MPa or more, and have obtained the following findings.

[Chemical composition, and Formulae (1) and (2)]

It is known that Ca is effective for improving hot workability of steel material. Further, it is generally known that Cr, Mo, Cu, and Ni are effective for improving SSC resistance of steel material. Specifically, it is considered that Cr, Mo and Cu solid-solve into a steel material, thereby improving SSC resistance thereof. On the other hand, Ni is considered to improve SSC resistance of a steel material by strengthening a film on the surface of the steel material, thereby reducing the amount of hydrogen (the amount of hydrogen permeation) intruding into steel material. However, as a result of the investigation by the present inventors, it was found for the first time that the film strengthening by Ni reduces the hydrogen diffusion coefficient in steel in a highly corrosive environment as described above. If the diffusion coefficient of hydrogen in steel is reduced, hydrogen becomes more likely to stay in steel. As a result, the SSC resistance of steel material deteriorates.

Accordingly, for achieving hot workability and SSC resistance of a steel material at the same time, the present inventors have investigated the Ca content which affects hot workability, and the contents of Cr Mo, Cu, and Ni which affect SSC resistance. As a result of that, they have found that in a steel material having a chemical composition, which consists of: in mass %, C: 0.030% or less, Si: 1.00% or less, Mn: 1.00% or less, P: 0.030% or less, S: 0.005% or less, Al: 0.0010 to 0.100%, N: 0.0010 to 0.0100%, Ni: 5.00 to 6.50%, Cr: 10.00 to 13.40%, Cu: 1.80 to 3.50%, Mo: 1.00 to 4.00%, V: 0.01 to 1.00%, Ti: 0.050 to 0.300%, Co: 0.300% or less, Ca: 0.0006 to 0.0030%, O: 0.0050% or less, and W: 0 to 1.50%, with the balance being Fe and impurities, if the contents of Cr, Mo, Cu, and Ni satisfy the following Formula (1), excellent SSC resistance will be obtained while improving hot workability:

$$11.5 \leq Cr+2Mo+2Cu-1.5Ni \leq 14.3 \quad (1)$$

where, each symbol of element in Formula (1) is substituted by the content (mass %) of the corresponding element.

Definition is made such that F1=Cr+2Mo+2Cu−1.5Ni. FIG. 1 is a diagram to show relation between F1=Cr+2Mo+2Cu−1.5Ni, and yield strength YS (MPa) and SSC resistance. FIG. 1 has been created by using examples in which the content of each element is within the range of the present embodiment. The symbol "○" in FIG. 1 indicates that no SSC has occurred in a SSC resistance evaluation test according to examples described below. The symbol "x" in FIG. 1 indicates that SSC has occurred in the SSC resistance evaluation test in examples described below.

Referring to FIG. 1, in a case in which the yield strength of steel material is 724 to 861 MPa, SSC resistance will deteriorate when F1 is less than 11.5, or when F1 is more than 14.3. On the other hand, in a case in which the yield strength of steel material is 724 to 861 MPa, excellent SSC resistance will be obtained when F1 is 11.5 to 14.3. Note that even if the chemical composition is satisfied and F1 is 11.5 to 14.3, SSC resistance will deteriorate when the yield strength is more than 861 MPa. Therefore, the present inventors considered that if the steel material has the chemical composition which satisfies Formula (1), and the yield strength is 724 to 861 MPa, there is possibility that excellent SSC resistance is obtained.

However, it was found that even in a martensitic stainless steel having a chemical composition that satisfies Formula (1) and having a yield strength of 724 to 861 MPa, there is a case in which SSC resistance deteriorates. Accordingly, further investigation has been made on the cause of deterioration of SSC resistance to find the following items.

When Ca is contained to improve hot workability, Ca oxide is formed in steel material. In the present description, Ca oxide means an inclusion of which Ca content is 25.0% or more in mass %, 0 content is 20.0% or more in mass %, and Si content is 10.0% or less in mass % when the mass % of the entire inclusion is 100%. As a result of the investigation by the present inventors, it has been found that Ca oxide will melt in a highly corrosive environment which contains hydrogen sulfide and carbon dioxide gas, and in which the partial pressure of hydrogen sulfide is 0.1 atm or more. When the Ca oxide has melted, pitting occurs in the steel material. As a result, the SSC tends to occur starting from the pitting and the SSC resistance deteriorates.

Therefore, the present inventors investigated a method of suppressing the melting of Ca oxide in the highly corrosive environment. In a steel material having the chemical composition satisfying the Formula (1), inclusions are formed in molten steel. In the steel material having the chemical composition satisfying Formula (1), Ti nitrides (TiN) are also formed as inclusions in addition to Ca oxide. Therefore, the inventors have further investigated the relationship between the morphology of inclusions in steel material and the SSC resistance. As a result, it was found that different inclusions are formed according to the differences in the contents of Ti, N and C. Specifically, it has been found that in the chemical composition satisfying Formula (1), there are cases in which the surface of Ca oxide is sufficiently coated with Ti nitride and in which the surface of Ca oxide is not sufficiently coated with Ti nitride depending on the difference in the contents of Ti, N, and the C. Further, pitting is likely to occur in Ca oxide which is not sufficiently coated with Ti nitride.

Then, the present inventors have investigated the relationship between the contents of Ti, C, and N and occurrence of pitting in the chemical composition that satisfies Formula (1). As a result, it was found that in the chemical composition that satisfies Formula (1), if the contents of Ti, C, and N satisfy Formula (2), occurrence of pitting attributable to Ca oxide can be suppressed, thus improving SSC resistance:

$$Ti/(C+N) \geq 6.4 \quad (2)$$

where, each symbol of element in Formula (2) is substituted by the content (mass %) of the corresponding element.

[Intermetallic Compounds and Cr Oxides in Steel]

It is known that if a coarse intermetallic compound and a coarse Cr oxide are present in the microstructure of a steel material, the coarse intermetallic compound and the coarse Cr oxide work as the origin of SSC, and the SSC resistance deteriorates. Therefore, conventionally, the SSC resistance of steel materials is improved by refining Cr oxides and generating fine intermetallic compounds. That is, it has been considered that fine Cr oxides and fine intermetallic compounds do not affect SSC resistance.

However, the present inventors have newly found that in a martensitic stainless steel material having the chemical composition that satisfies Formulae (1) and (2), and having a yield strength of 724 to 861 MPa, even Cr oxides and intermetallic compounds of a size, which is conventionally considered to be fine, will deteriorate SSC resistance. As a result of further investigation, they have found that in the martensitic stainless steel material having the chemical composition that satisfies the Formulae (1) and (2), and having a yield strength of 724 to 861 MPa, if the area of each intermetallic compound and each Cr oxide in the steel material is 5.0 $\mu m^2$ or less, and if a total area fraction of Cr oxide and intermetallic compound is 3.0% or less, the SSC resistance is further improved.

Here, the intermetallic compound in the present specification is a precipitate of an alloy element precipitated after tempering. The intermetallic compound in the present invention is any one or more kinds of a Laves phase such as $Fe_2Mo$, a sigma phase (a phase), and a chi phase ($\chi$ phase). The $\sigma$ phase is FeCr, and $\chi$ phase is $Fe_{36}Cr_{12}Mo_{10}$. Further, the Cr oxide is chromia ($Cr_2O_3$).

Intermetallic compounds and Cr oxides can be identified by performing structural observation by use of an extraction replica method. The sum of the area of the identified intermetallic compounds and the area of the identified Cr oxides is taken as a total area ($\mu m^2$) of intermetallic compound and Cr oxide. The percentage (%) of the total area of intermetallic compound and Cr oxide to the area of the entire observation region is defined as a total area fraction (%) of intermetallic compound and Cr oxide.

In the martensitic stainless steel material satisfying Formulae (1) and (2), and having a yield strength of 724 to 861 MPa, if an intermetallic compound having an area of more than 5.0 $\mu m^2$ or a Cr oxide of more than 5.0 $\mu m^2$ is present, the intermetallic compound or the Cr oxide works as an origin of SSC, thus deteriorating SSC resistance. Therefore, in the microstructure, the size of each intermetallic compound is 5.0 $\mu m^2$ or less, and the area of each Cr oxide is 5.0 $\mu m^2$ or less. That is, in the present embodiment, neither an intermetallic compound the area of which is more than 5.0 $\mu m^2$ nor a Cr oxide the area of which is more than 5.0 $\mu m^2$ are observed in the observation of microstructure to be described later.

In the martensitic stainless steel material satisfying Formulae (1) and (2) and having a yield strength of 724 to 861 MPa, if further a total area fraction of intermetallic compound and Cr oxide is more than 3.0%, fine intermetallic compounds and Cr oxides will be excessively present even if the area of each intermetallic compound and each Cr oxide is 5.0 $\mu m^2$ or less. In this case, SSC resistance also deteriorates. Therefore, the total area fraction of intermetallic compound in steel material is 3.0% or less.

[Ca Oxides]

Further, the present inventors have obtained the following findings regarding to the circle-equivalent diameter of Ca oxide. In a steel material in which Formulae (1) and (2) are satisfied, even when the yield strength is 724 to 861 MPa; the volume ratio of martensite in the microstructure is 80% or more; the size of each intermetallic compound and each Cr oxide is 5.0 $\mu m^2$ or less in steel material; and the total area fraction of intermetallic compound and Cr oxide in steel material is 3.0% or less; if the Ca oxide in the steel material is coarse, Ca oxide is likely to be melted in a highly corrosive environment. In this case, pitting becomes likely to occur and as a result, the SSC resistance of the martensitic stainless steel material deteriorates. Specifically, in the martensitic stainless steel material of the present embodiment, if the maximum circle-equivalent diameter of Ca oxide is more than 9.5 μm the SSC resistance of steel material deteriorates. If the maximum circle-equivalent diameter of Ca oxide is 9.5 μm or less, sufficient SSC resistance is obtained. Hence, the equivalent circle diameter means the diameter (μm) of the circle when the area of the Ca oxide is assumed to be a circle having the same area.

The martensitic stainless steel material completed on the above findings has a following structures.

A martensitic stainless steel material of [1], comprising a chemical composition consisting of in mass %, C: 0.030% or less,
Si: 1.00% or less,
Mn: 1.00% or less,
P: 0.030% or less,
S: 0.005% or less,
Al: 0.010 to 0.100%,
N: 0.0010 to 0.0100%,
Ni: 5.00 to 6.50%,
Cr: 10.00 to 13.40%,
Cu: 1.80 to 3.50%,
Mo: 1.00 to 4.00%,
V: 0.01 to 1.00%,
Ti: 0.050 to 0.300%,
Co: 0.300% or less,
Ca: 0.0006 to 0.0030%,
O: 0.0050% or less, and
W: 0 to 1.50%, with the balance being Fe and impurities, and satisfying Formulae (1) and (2), wherein a yield strength is 724 to 861 MPa, a volume ratio of martensite is 80% or more in the microstructure, an area of each intermetallic compound and each Cr oxide in the steel material is 5.0 $\mu m^2$ or less, and a total area fraction of intermetallic compounds and Cr oxides is 3.0% or less, and a maximum circle-equivalent diameter of an oxide containing Ca is 9.5 μm or less in the steel material:

$$11.5 \leq Cr+2Mo+2Cu-1.5Ni \leq 14.3 \quad (1)$$

$$Ti/(C+N) \geq 6.4 \quad (2)$$

where, each symbol of element in Formulae (1) and (2) is substituted by the content (in mass %) of the corresponding element.

In the present description, the intermetallic compound is any one or more kinds of a Laves phase such as $Fe_2Mo$, a sigma phase (σ phase), and a chi phase ex phase). The σ phase is FeCr, and the χ phase is $Fe_{36}Cr_{12}Mo_{10}$.

In the present description, the Cr oxide is chromia ($Cr_2O_3$).

In the present description, Ca oxide means an inclusion the Ca content of which is 25.0% or more in mass %, 0 content is 20.0% or more in mass %, and Si content is 10.0% or less in mass %.

A martensitic stainless steel material of [2] is the martensitic stainless steel material according to [1], wherein, the chemical composition of the martensite stainless steel material may contain W: 0.10 to 1.50%.

A martensitic stainless steel material of [3] is the martensitic stainless steel material according to [1] or [2], wherein, the martensitic stainless steel material is a seamless steel pipe for oil country tubular goods.

As used herein, "oil country tubular goods" means a general term for casing pipes, tubing pipes, and drill pipes used for drilling oil or gas wells, collecting crude oil or natural gas, and the like. A "seamless steel pipe for oil country tubular goods" means that a steel pipe for oil country tubular goods is a seamless pipe.

Hereinafter, the martensitic stainless steel material of the present embodiment will be described in detail. The term "%" with respect to an element means, unless otherwise noted, mass %.

[Chemical Composition]

The chemical composition of the martensitic stainless steel material of the present embodiment contains the following elements.

C: 0.030% or Less

Carbon (C) is unavoidably contained. That is, the C content is more than 0%. C improves hardenability, thus increasing strength of steel material. However, when the C content is too high, the strength of steel material will become too high, thus deteriorating SSC resistance even if the contents of other elements are within the range of the present embodiment. Therefore, the C content is 0.030% or less. The C content is preferably as low as possible. However, excessively reducing the C content will result in increase in production cost. Therefore, considering industrial production, the lower limit of the C content is preferably 0.001%. From the viewpoint of the strength of steel material, the lower limit of the C content is preferably 0.002%, more preferably 0.005%, and further preferably 0.007%. The upper limit of the C content is preferably 0.020%, more preferably 0.018%, more preferably 0.016%, and more preferably 0.015%.

Si: 1.00% or Less

Silicon (Si) is unavoidably contained. That is, the Si content is more than 0%. Si deoxidizes steel. However, when the Si content is too high, this effect will be saturated. Therefore, the Si content is 1.00% or less. The lower limit of the Si content is preferably 0.05%, and more preferably 0.10%. The upper limit of the Si content is preferably 0.70%, and more preferably 0.50%.

Mn: 1.00% or Less

Manganese (Mn) is unavoidably contained. That is, the Mn content is more than 0%. Mn improves hardenability of steel. However, when the Mn content is too high, Mn segregates at grain boundaries with impurity elements such as P and 5, etc. In such a case, SSC resistance will deteriorate even if the contents of other elements are within the range of the present embodiment. Therefore, the Mn content is 1.00% or less. The lower limit of the Mn content is preferably 0.15%, more preferably 0.18%, and more preferably 0.20%. The upper limit of the Mn content is preferably 0.80%, more preferably 0.60%, and more preferably 0.50%.

P: 0.030% or Less

Phosphorous (P) is an impurity which is unavoidably contained. That is, the P content is more than 0%. P segregates at grain boundaries, thus deteriorating SSC resistance of steel. Therefore, the P content is 0.030% or less. The upper limit of the P content is preferably 0.025%, and more preferably 0.020%. The P content is preferably as low as possible. However, excessively reducing the P content will result in increase in production cost. Therefore, considering industrial production, the lower limit of the P content is preferably 0.001%, more preferably 0.002%, and more preferably 0.005%.

S: 0.005% or Less

Sulfur (S) is an impurity which is unavoidably contained. That is, the S content is more than 0%. As with P, S segregates at grain boundaries, thus deteriorating SSC resistance. Therefore, the S content is 0.005% or less. The upper limit of the S content is preferably 0.004%, more preferably 0.003%, and more preferably 0.002%. The S content is preferably as low as possible. However, excessively reducing the S content will result in increase in production cost. Therefore, considering industrial production, the lower limit of the S content is preferably 0.001%.

Al: 0.010 to 0.100%

Aluminum (Al) deoxidizes steel. When the Al content is low, such effect will not be obtained even if the contents of other elements are within the range of the present embodiment. On the other hand, when the Al content is too high, such effect will be saturated. Therefore, the Al content is 0.010 to 0.100%. The lower limit of the Al content is preferably 0.012%, more preferably 0.015%, more preferably 0.020%, more preferably 0.025%, and more preferably 0.030%. The upper limit of the Al content is preferably 0.070%, more preferably 0.060% and more preferably 0.050%. The Al content as used herein means the content of sol. Al (acid soluble Al).

N: 0.0010 to 0.0100%

Nitrogen (N) forms Ti nitride. On the condition of satisfying Formula (2), N forms Ti nitride on the surface of Ca oxide. This will suppress melting of Ca oxide in a highly corrosive environment, thereby suppressing occurrence of pitting. Therefore, SSC resistance of steel material is improved. When the N content is too low, this effect cannot be sufficiently obtained even if the contents of other elements are within the range of the present embodiment. On the other hand, when the N content is too high, coarse TiN will be formed, thereby deteriorating SSC resistance of steel material. Therefore, the N content is 0.0010% to 0.0100%. The lower limit of the N content is preferably 0.0015%, and more preferably 0.0020%. The upper limit of the N content is preferably 0.0090%, more preferably 0.0080%, further preferably 0.0070%, further preferably 0.0060%, and further preferably 0.0050%.

Ni: 5.00 to 6.50%

Nickel (Ni) is an austenite forming element and causes the structure after tempering to become martensitic. When the Ni content is too low, the structure after tempering will contain much ferrite even if the contents of other elements are within the range of the present embodiment. On the other hand, when the Ni content is too high, Ni reduces the hydrogen diffusion coefficient in steel through film strengthening in a highly corrosive environment. Such reduction of hydrogen diffusion coefficient in steel will deteriorate SSC resistance. Therefore, the Ni content is 5.00 to 6.50%. The lower limit of the Ni content is preferably 5.10%, more preferably 5.20%, more preferably 5.25%, and more preferably 5.30%. The upper limit of the Ni content is preferably 6.40%, more preferably 6.30%, more preferably 6.25%, and more preferably 6.20%.

Cr: 10.00 to 13.40%

Chromium (Cr) improves carbon-dioxide gas corrosion resistance of steel material. When the Cr content is too low, this effect cannot be obtained even if the contents of other elements are within the range of the present embodiment. On the other hand, when the Cr content is too high, intermetallic compounds and Cr oxides are excessively produced, and coarse intermetallic compounds and/or coarse Cr oxides are produced, thereby deteriorating SSC resistance of steel even if the contents of other elements are within the range of the present embodiment. Therefore, the Cr content is 10.00 to 13.40%. The lower limit of the Cr content is preferably 11.00%, more preferably 11.30%, and more preferably 11.50%. The upper limit of the Cr content is preferably 13.30%, more preferably 13.25%, more preferably 13.15%, and more preferably 13.00%.

Cu: 1.80 to 3.50%

Cupper (Cu) is an austenite forming element as with Ni, and causes the structure after tempering to become martensitic. Further, Cu solid-solves into steel, thereby improving SSC resistance. When the Cu content is too low, these effects cannot be obtained even if the contents of other elements are within the range of the present embodiment. On the other hand, when the Cu content is too high, hot workability will deteriorate even if the contents of other elements are within the range of the present embodiment. Therefore, the Cu content is 1.80 to 3.50%. The lower limit of the Cu content is preferably 1.85%, more preferably 1.90%, and more preferably 1.95%. The upper limit of the Cu content is preferably 3.40%, more preferably 3.30%, more preferably 3.20%, and more preferably 3.10%.

Mo: 1.00 to 4.00%

Molybdenum (Mo) improves the SSC resistance and the strength of steel material. When the Mo content is too low, these effects cannot be obtained even if the contents of other elements are within the range of the present embodiment. On the other hand, Mo is a ferrite forming element. Therefore, when the Mo content is too high, austenite is not likely to be stabilized, and a microstructure mainly composed of martensite will not be obtained in a stable manner even if the contents of other elements are within the range of the present embodiment. Therefore, the Mo content is 1.00 to 4.00%.

The lower limit of the Mo content is preferably 1.20%, more preferably 1.50%, and further preferably 1.80%. The upper limit of the Mo content is preferably 3.70%, more preferably 3.50%, more preferably 3.20%, more preferably 3.00%, and more preferably 2.70%.

V: 0.01 to 1.00%

Vanadium (V) solid-solves into steel and suppresses intergranular cracking of steel in a highly corrosive environment. When the V content is too low, this effect cannot be obtained even if the contents of other elements are within the range of the present embodiment. On the other hand, V improves hardenability of steel material, and is likely to form carbides. Therefore, when the V content is too high, the strength of steel material is increased and SSC resistance will deteriorate even if the contents of other elements are within the range of the present embodiment. Therefore, the V content is 0.01 to 1.00%. The lower limit of the V content is preferably 0.02%, and more preferably 0.03%. The upper limit of the V content is preferably 0.80%, and more preferably 0.70%, more preferably 0.60%, more preferably 0.50%, and more preferably 0.40%.

Ti: 0.050 to 0.300%

Titanium (Ti) combines with C to form carbides. As a result, C for forming VC is consumed by Ti, thus suppressing formation of VC. For that reason, SSC resistance of steel is improved. When the Ti content is too low, this effect cannot be obtained. When the Ti content is too low, this effect cannot be obtained even if the contents of other elements are within the range of the present embodiment. On the other hand, the Ti content is too high, the above described effect will be saturated, and further, formation of ferrite is promoted. Therefore, the Ti content is 0.050 to 0.300%. The lower limit of the Ti content is preferably 0.060%, more preferably 0.070%, and further preferably 0.080%. The upper limit of the Ti content is preferably 0.250%, more preferably 0.200%, more preferably 0.180%, and more preferably 0.150%.

Co: 0.300% or Less

Cobalt (Co) is an impurity which is unavoidably contained. That is, the Co content is more than 0%. When the Co content is too high, ductility and toughness deteriorate even if the contents of other elements are within the range of the present embodiment. Therefore, the Co content is 0.300% or less. The upper limit of the Co content is preferably 0.270%, more preferably 0.260%, more preferably 0.250%, more preferably 0.230%, and more preferably 0.200%. The Co content is preferably as low as possible. However, excessive reduction of the Co content will result in increase in production cost. Therefore, considering industrial production, the lower limit of the Co content is preferably 0.001%, more preferably 0.005%, and further preferably 0.010%.

Ca: 0.0006 to 0.0030%

Calcium (Ca) controls the morphology of inclusions and improves hot workability of steel material. Here, controlling the morphology of inclusions means, for example, spheroidizing the inclusions. When the Ca content is too low, this effect cannot be obtained even if the contents of other elements are within the range of the present embodiment. On the other hand, when the Ca content is too high, Ca oxides are coarsened, and Ca oxides are excessively produced. In such cases, pitting becomes more likely to occur, thereby deteriorating SSC resistance even if the contents of other elements are within the range of the present embodiment. Therefore, the Ca content is 0.0006 to 0.0030%. The lower limit of the Ca content is preferably 0.0008%, more preferably 0.0010%, further preferably 0.0012%, and further preferably 0.0015%. The upper limit of the Ca content is preferably 0.0028%, and more preferably 0.0026%.

O: 0.0050% or Less

Oxygen (O) is an impurity which is unavoidably contained. That is, the O content is more than 0%. O forms Cr oxides and C oxides, thereby deteriorating SSC resistance. Therefore, the O content is 0.0050% or less. The upper limit of the O content is preferably 0.0046%, more preferably 0.0040%, and more preferably 0.0035%. The O content is preferably as low as possible. However, excessively reducing the O content will result in increase in production cost. Therefore, considering industrial production, the lower limit of the O content is preferably 0.0001%, and more preferably 0.0005%.

The balance of the martensitic stainless steel according to the present embodiment is made up of Fe and impurities. Here, impurities include those which are mixed from ores and scraps as the raw material, or from the production environment when industrially producing a steel material, and which are permitted within a range not adversely affecting the martensitic stainless steel material of the present embodiment.

The chemical composition of the martensitic stainless steel material according to the present embodiment may contain W in place of part of Fe.

W: 0 to 1.50%

Tungsten (W) is an optional element, and may not be contained. That is, the W content may be 0%. When contained, W stabilizes passivation film, thus improving corrosion resistance. However, when the W content is too high, W combines with C to from fine carbides. This fine carbides increase the strength of steel material by fine precipitation hardening and as a result, deteriorates SSC resistance. Therefore, the W content is 0 to 1.50%. The lower limit of the W content is preferably 0.10%, more preferably 0.15%, and more preferably 0.20%. The upper limit of the W content is preferably 1.40%, more preferably 1.20%, more preferably 1.00%, and more preferably 0.50%.

[Formula (1)]

The chemical composition further satisfies Formula (1):

$$11.5 \leq Cr+2Mo+2Cu-1.5Ni \leq 14.3 \quad (1)$$

where, each symbol of element in Formula (1) is substituted by the content (mass %) of the corresponding element.

Definition is made such that F1=Cr+2Mo+2Cu−1.5Ni. F1 is an index of SSC resistance in the steel material having the chemical composition. Referring to FIG. 1, when F1 is less than 11.5, even if the content of each element is within the above range, SSC resistance will deteriorate. It is considered that SSC resistance deteriorates since the Ni content which reduces the hydrogen diffusion coefficient in steel is too high with respect to the contents of Cr, Mo, and Cu, which solid-solve into steel and thereby improving SSC resistance. On the other hand, when F1 is more than 14.3, even if the content of each element is within the above range, SSC resistance also deteriorates. It is presumed that the amount of hydrogen intrusion increases because the Ni content, which form a film on the surface and suppresses intrusion of hydrogen, is too low with respect to the contents of Cr, Mo, and Cu, which improve SSC resistance, and as a result, SSC resistance deteriorates. Therefore, F1 is 11.5 to 14.3. The lower limit of F1 is preferably 11.7, more preferably 11.8, more preferably 12.0, more preferably 12.2, more preferably 12.5. The upper limit of F1 is preferably 14.2, more preferably 14.0, more preferably 13.9, and more preferably 13.8.

As described above, each symbol of element of F1 is substituted by the content (mass %) of the corresponding element. The value of F1 is a value obtained by rounding off the second decimal place of the calculated value.

[Formula (2)]

The chemical composition satisfies Formula (1) and further satisfies Formula (2):

$$Ti/(C+N) \geq 6.4 \quad (2)$$

where, each symbol of element in Formula (2) is substituted by the content (mass %) of the corresponding element.

Definition is made such that F2=Ti/(C+N). F2 is an index to show a level at which Ti nitride is coated on the surface of Ca oxide. As described above, in the chemical composition which satisfies Formula (I), there are cases in which the surface of Ca oxide is sufficiently coated with Ti nitride and in which the surface of Ca oxide is not sufficiently coated with Ti nitride depending on the difference in the contents of Ti, N, and C. When F2 is less than 6.4, Ca oxide which is not sufficiently coated with Ti nitride is present in an excess amount. In this case, Ca oxide is likely to melt in a highly corrosive environment so that pitting is likely to occur. For that reason, the SSC resistance of martensitic stainless steel material deteriorates.

On the other hand, when F2 is 6.4 or more, since a large number of Ca oxides which are sufficiently coated with Ti nitride are present. In this case, the Ca oxides are not likely to melt in a highly corrosive environment. For that reason, the SSC resistance of martensitic stainless steel material is improved. The lower limit of F2 is preferably 6.5, more preferably 6.6, more preferably 6.7, more preferably 6.8, and further preferably 6.9.

As described so far, each symbol of element of F2 is substituted by the content (mass %) of the corresponding element. The value of F2 is a value obtained by rounding off the second decimal place of a calculated value.

[Volume Ratio of Martensite: 80% or More]

The microstructure of the martensitic stainless steel material is mainly composed of martensite. In the present description, martensite includes not only fresh martensite but also tempered martensite. Mainly composed of martensite means that the volume ratio of martensite is 80% or more in the microstructure. The balance of the structure is retained austenite. Namely, the volume ratio of retained austenite is 0 to 20%. The volume ratio of retained austenite is preferably as low as possible. The lower limit of the volume ratio of martensite in the structure is preferably 85%, more preferably 90%, and more preferably 95%. Further preferably, the metallographic structure is of a martensite single phase.

In the microstructure, a small amount of retained austenite will not cause significant decrease in strength, and remarkably improves the toughness of steel. However, when the volume ratio of retained austenite is too high, the strength of steel remarkably decreases. Therefore, the volume ratio of retained austenite is 0 to 20% as described above. From the viewpoint of ensuring strength, the upper limit of the volume ratio of retained austenite is preferably 15%, more preferably 10%, and more preferably 5%. As described above, the microstructure of the martensitic stainless steel material of the present embodiment may be of a martensite single phase. In this case, the volume ratio of retained austenite is 0%. On the other hand, when even a small amount of retained austenite is present, the volume ratio of retained austenite is more than 0% to 20% or less, more preferably more than 0% to 15%, more preferably more than 0% to 10%, and further preferably more than 0% to 5%.

[Measurement Method of Volume Ratio of Martensite]

The volume ratio (vol %) of martensite is determined by subtracting the volume ratio (vol %) of retained austenite, which has been determined by the following method, from 100%.

The volume ratio of retained austenite is determined by an X-ray diffraction method. Specifically, a sample is collected from a martensitic stainless steel material. When the martensitic stainless steel material is a steel pipe, a sample is collected from a central position of wall thickness. When the martensitic stainless steel material is a steel plate, a sample is collected from a central position of plate thickness. Although the size of the sample is not particularly limited, it is, for example, 15 mm×15 mm×thickness of 2 mm By using the obtained sample, X-ray diffraction intensity of each of the (200) plane of a phase (ferrite and martensite), the (211) plane of a phase, the (200) plane of γ phase (retained austenite), the (220) plane of γ phase, the (311) plane of γ phase is measured to calculate an integrated intensity of each plane. In the measurement of the X-ray diffraction intensity, the target of the X-ray diffraction apparatus is Mo (MoKα ray), and the output thereof is 50 kV-40 mA. After calculation, the volume ratio Vγ (%) of retained austenite is calculated using Formula (I) for combinations (2×3=6 pairs) of each plane of the α phase and each plane of the γ phase. Then, an average value of the volume ratios Vγ of retained austenite of the six pairs is defined as the volume ratio (%) of retained austenite.

$$V\gamma = 100/\{1\alpha \times R\gamma)/(I\gamma \times R\alpha)\} \quad (I)$$

where, Iα is an integrated intensity of α phase. Rα is a crystallographic theoretical calculation value of a phase. Iγ is the integrated intensity of γ phase. Rγ is a crystallographic theoretical calculation value of γ phase. In the present description, Rα in the (200) plane of α phase is 15.9, Rα in the (211) plane of a phase is 29.2, and Rγ in the (200) plane of γ phase is 35.5, Rγ in the (220) plane of γ phase is 20.8, and Rγ in the (311) plane of γ phase is 21.8.

Using the volume ratio (%) of retained austenite obtained by the X-ray diffraction method, the volume ratio of martensite of the microstructure of the martensitic stainless steel material is determined by the following Formula.

$$\text{Volume ratio of martensite (\%)} = 100 - \text{volume ratio of retained austenite (\%)}$$

Namely, a value obtained by subtracting the volume ratio of retained austenite obtained by the above described method from 100% is supposed to be the volume ratio (vol %) of martensite in the microstructure. The value of the volume ratio of martensite is a value obtained by rounding off the first decimal place of the calculated value.

[Yield Strength]

The yield strength of the martensitic stainless steel material of the present embodiment is 724 to 861 MPa. If the yield strength is less than 724 MPa, it does not satisfy the strength which is applicable to a highly corrosive environment. On the other hand, if the yield strength is more than 861 MPa, as shown in FIG. 1, SSC resistance deteriorates in a steel material of the chemical composition satisfying Formulae (1) and (2). Therefore, the yield strength of the martensitic stainless steel material of the present embodiment is 724 to 861 MPa. The upper limit of the yield strength is preferably 855 MPa, more preferably 850 MPa, more preferably 845 MPa, and more preferably 840 MPa. The lower limit of the yield strength is preferably 730 MPa, more preferably 735 MPa, and more preferably 740 MPa. As used herein, yield strength means 0.2% offset proof stress (MPa).

The yield strength of the martensitic stainless steel material of the present embodiment is determined by the following method. Tensile test specimens are collected from a central position in the thickness direction of martensitic stainless steel material. The central position in the thickness direction is a wall-thickness central position when the martensitic stainless steel material is a steel pipe, and a plate-thickness central position when the martensitic stainless steel material is the steel plate. The tensile test specimen is a round bar tensile test specimen having a parallel portion the diameter of which is 8.9 mm and the length of which is 35.6 mm. The longitudinal direction of the parallel portion of this test specimen is parallel to the longitudinal direction (a pipe axial direction of the steel pipe or a rolling direction (longitudinal direction) of the steel plate) of the martensitic stainless steel material. When the thickness of the steel material (wall thickness in the case of a steel pipe, plate thickness in the case of a steel plate) is less than 8.9 mm, the parallel portion diameter of the tensile test specimen is 6.25 mm and the parallel portion length is 25 mm. When the thickness of the steel material is less than 6.25 mm, the parallel portion of the tensile test specimen has a diameter of 4 mm, and a length of 16 mm. Using this test specimen, a tensile test is conducted at normal temperature (24±3° C.) in accordance with ASTM E8/E8M to define 0.2% offset proof stress as the yield strength YS (MPa).

[Intermetallic Compound and Cr Oxide in Steel Material]

Furthermore, in the martensitic stainless steel material of the present embodiment, the area of each intermetallic compound and each Cr oxide is 5.0 $\mu m^2$ or less, and a total area fraction of intermetallic compound and Cr oxide in the structure is 3.0% or less, in the steel material. That is, in the present embodiment, any intermetallic compound and Cr oxide having an area of more than 5.0 $\mu m^2$ will not be observed.

Here, the intermetallic compound is a precipitate of alloy element precipitated after tempering. The intermetallic compound is any one or more kinds of a Laves phase such as $Fe_2Mo$, a sigma phase ($\sigma$ phase), and a chi phase ($\chi$ phase). In the case of the chemical composition of the present embodiment described above, since there are very few intermetallic compounds other than the Laves phase, the $\sigma$ phase, and the $\chi$ phase, they can be ignored without problem. Moreover, the Cr oxide is chromia ($Cr_2O_3$).

Even if a steel material has the chemical composition which satisfies Formulae (1) and (2), a volume ratio of martensite of 80% or more, and a yield strength of 724 to 861 MPa, when any intermetallic compound or Cr oxide having an area of more than 5.0 $\mu m^2$ is present among the intermetallic compounds and Cr oxides in the structure, or when the total area fraction of intermetallic compound and Cr oxide is more than 3.0%, SSC will occur caused by the intermetallic compound and the Cr oxide, thereby deteriorating SSC resistance. If the size of each intermetallic compound and each Cr oxide is 5.0 $\mu m^2$ or less, and the total area fraction of intermetallic compound and Cr oxide is 3.0% or less, these intermetallic compound and Cr oxide do not affect SSC resistance. Therefore, excellent SSC resistance is maintained.

The total area fraction of intermetallic compound and Cr oxide in steel material is preferably as low as possible. The lower limit of the total area fraction of intermetallic compound and Cr oxide is preferably 2.5%, more preferably 2.0%, further preferably 1.5%, and further preferably 1.0%. Further preferably, the total area fraction of intermetallic compound and Cr oxide is 0%.

If the area of each intermetallic compound and each Cr oxide is 5.0 $\mu m^2$ or less, the influence on SSC resistance is small. Even if the area of each intermetallic compound and each Cr oxide is 1.0 $\mu m^2$, 2.0 $\mu m^2$ or 5.0 $\mu m^2$, the influence on the SSC resistance is small. The area of each intermetallic compound and each Cr oxide is preferably 4.5 $\mu m^2$ or less, and more preferably 4.0 $\mu m^2$ or less. However, even if the area of each intermetallic compound and each Cr oxide is 5.0 $\mu m^2$ or less, if the total area fraction is more than 3.0%, the SSC resistance remarkably deteriorates.

[Measurement Method of Area of Each Intermetallic Compound and Each Cr Oxide, and Total Area Fraction of Intermetallic Compound and Cr Oxide]

The area of each intermetallic compound and each Cr oxide, and the total area fraction of intermetallic compound and Cr oxide are measured by observing the structure using an extraction replica method. Specifically, measurement is made in the following method.

Specimens are collected from central positions in the thickness direction of the martensitic stainless steel material. The central position in the thickness direction is a wall-thickness central position when the martensitic stainless steel material is a steel pipe, and a plate-thickness central position when the martensitic stainless steel material is a steel plate. One of the test specimens is collected from a front end part (TOP part) of the steel material in the longitudinal direction, and another is collected from a rear end part (BOTTOM part). The front end part means a section at the front end when the steel material is divided into ten equal sections in the longitudinal direction, and the rear end part means a section at the rear end. The size of the test specimen is not particularly limited.

From the surface of the collected test specimen, an extraction replica film is prepared based on the extraction replica method. Specifically, the surface of the test specimen is electropolished. The surface of the test specimen after the electropolishing is etched using Vilella's reagent (an ethanol solution containing 1 to 5 g of hydrochloric acid and 1 to 5 g of picric acid). Thereby, precipitates and inclusions are exposed from the surface. A part of the surface after etching is covered with a carbon vapor deposition film (hereinafter, referred to as an extraction replica film). The test specimen the part of the surface of which is covered with the extraction replica film is immersed in a bromine methanol solution (bromomethanol) to dissolve the test specimen, thereby causing the extraction replica film to be peeled off from the test specimen. The peeled extraction replica film has a disc shape having a diameter of 3 mm. Using a TEM (transmission electron microscope), an arbitrary region of 10 $\mu m^2$ is observed at four places (4 fields of view) at a magnification of 20000 times in each extraction replica film. That is, in one steel material, regions of eight places (hereinafter referred as observation regions) are observed.

Element concentration analysis (EDS point analysis) using energy dispersive X-ray spectrometry (hereinafter referred to as EDS) is conducted for precipitates or inclusions confirmed by the backscattered electron image of each observation region. Intermetallic compounds and Cr oxides are identified based on the element concentration obtained from each precipitate or inclusion by the EDS point analysis. Individual areas ($\mu m^2$) of the identified intermetallic compounds (the Laves phase, the sigma phase ($\sigma$ phase), and the chi phase ($\chi$ phase)) and Cr oxide are determined. The total of the areas of intermetallic compound and the area of the Cr oxide is taken as a total area ($\mu m^2$) of intermetallic compound and Cr oxide. The ratio of the total area of intermetallic compound and Cr oxide to the total area (80 $\mu m^2$) of the entire observation region is defined as the total area fraction (%) of intermetallic compound and Cr oxide.

Note that the area of intermetallic compound and Cr oxide that can be observed by the above described method is 0.05 $\mu m^2$ or more. Therefore, in the present embodiment, the lower limit of the size (area) of the intermetallic compound and Cr oxide to be measured is 0.05 $\mu m^2$. Note that the total area of the intermetallic compound of 0.05 $\mu m^2$ or less is negligibly small compared to the total area of the intermetallic compound having an area of 0.05 to 5.0 $\mu m^2$. The total area of Cr oxide of 0.05 $\mu m^2$ or less is negligibly small compared to the total area of Cr oxide having an area of 0.05 to 5.0 $\mu m^2$.

Moreover, when even one of intermetallic compound of a size of clearly not less than 5.0 $\mu m^2$, or Cr oxide of not less than 5.0 $\mu m^2$ is observed in the observation with an optical microscope and SEM (Scanning type electron micrograph), judgement may be made based thereon.

[Circle-Equivalent Diameter of Ca Oxide]

In a steel material in which Formulae (1) and (2) are satisfied, even when the yield strength is 724 to 861 MPa; the volume ratio of martensite in the microstructure is 80% or more; the size of each intermetallic compound and each Cr oxide is 5.0 $\mu m^2$ or less in steel material; and the total area fraction of intermetallic compound and Cr oxide in steel material is 3.0% or less; if the Ca oxide in the steel material is coarse, even if F2 satisfies the Formula (2), the coarse Ca oxide is not sufficiently covered with Ti nitride. Therefore, Ca oxide is likely to be melted in a highly corrosive environment. In this case, pitting becomes likely to occur and as a result, the SSC resistance of the martensitic stainless steel material deteriorates. Therefore, a smaller size of the Ca oxide is preferable. In the martensitic stainless steel material of the present embodiment, if the maximum circle-equivalent diameter of Ca oxide is more than 9.5 μm, the SSC resistance of steel material deteriorates. Therefore, the maximum circle-equivalent diameter of Ca oxide is 9.5 μm or less. The upper limit of the maximum circle-equivalent diameter of Ca oxide is preferably 9.3 μm or less, more preferably 9.1 μm or less, and further more preferably 8.8 μm or less. Note that a minimum circle-equivalent diameter of Ca oxide is not particularly limited, but is, for example, 0.05 μm. In other words, a circle-equivalent diameter of each Ca oxide is 0.05 to 9.5 μm.

As described above, in the present description, Ca oxide means an inclusion in which the Ca content is 25.0% or more in mass %, the oxygen content is 20.0% or more in mass %, and the Si content is 10.0% or less in mass %.

The maximum circle-equivalent diameter of Ca oxide is measured by the following method. A specimen is collected from a central position in the thickness direction of the martensitic stainless steel material. The central position in the thickness direction is a wall-thickness central position when the martensitic stainless steel material is a steel pipe, and a plate-thickness central position when the martensitic stainless steel material is a steel plate. One of the test specimen is collected from a front end part (TOP part) of the steel material in the longitudinal direction, and another is collected from a rear end part (BOTTOM part). The front end part means a section at the front end when the steel material is divided into ten equal sections in the longitudinal direction, and the rear end part means a section at the rear end. The size of the test specimen is not particularly limited.

The collected test specimen is embedded in resin, and the surface (observation surface) of the test specimen is polished. The surface (observation surface) of the test specimen to be polished is a surface corresponding to a cross section perpendicular to the longitudinal direction (axial direction) of the martensitic stainless steel material. The observation surface of the test specimen embedded in resin is polished. Thereafter, element concentration analysis (EDS point analysis) is performed in arbitrary 5 fields of view (5 fields of view in the TOP part, 5 fields of view in the BOTTOM part, and 10 fields of view in total) on the observation surface of each test specimen. Ca oxide in each field of view is identified based on the element concentration obtained from each precipitate or inclusion by EDS point analysis. The area of each field of view is 10 $\mu m^2$ (100 $\mu m^2$ in total).

The area of the identified Ca oxide is determined. From the obtained area, the circle-equivalent diameter (μm) of Ca oxide is determined. Here, the circle-equivalent diameter means a diameter (μm) when the obtained area is supposed to be a circle. Among the circle equivalent diameters of the identified Ca oxides, the maximum circle-equivalent diameter is defined as the maximum circle-equivalent diameter (μm) of Ca oxide. The area of Ca oxide can be calculated by known image analysis.

[Production Method]

An example of the production method of the martensitic stainless steel material is described. The production method of martensitic stainless steel material includes a step (preparation step) of preparing a starting material, a step (hot working step) of hot working the starting material to produce steel material, and a step (heat treatment step) of performing quenching and tempering on the steel material. Each step will be described in detail below.

[Preparation Step]

Molten steel which has the chemical composition and satisfies Formulae (1) and (2) is produced. The starting material is produced using the molten steel. Specifically, a cast piece (slab, bloom, or billet) is produced by a continuous casting process using the molten steel. An ingot may be produced by an ingot-making process using the molten steel. As desired, the slab, bloom or ingot may be subjected to blooming or hot forging to produce a billet. A starting material (slab, bloom or billet) is produced by the above processes.

[Hot Working Step]

The prepared starting material is heated. A preferable heating temperature is 1000 to 1300° C. The lower limit of the heating temperature is preferably 1150° C.

The heated material is subjected to hot working to produce a martensitic stainless steel material. When the martensitic stainless steel material is a steel plate, the starting material is subjected to, for example, hot rolling using one or more rolling mills including pairs of rolls, thereby producing a steel plate. In the case where the martensitic stainless steel material is a seamless steel pipe for oil country tubular goods, the seamless steel pipe is produced by subjecting the starting material to, for example, piercing-rolling, and elongating-rolling by the well-known Mannesmann-mandrel mill method and further, to sizing-rolling as needed.

[Heat Treatment Step]

The heat treatment step includes a quenching step and a tempering step. In the heat treatment step, first, the steel material produced in the hot working step is subjected to a quenching step. Quenching is carried out in a well-known manner. The quenching temperature is not lower than the $A_{C3}$ transformation point and is, for example, 900 to 1000° C. After holding the steel material at the quenching temperature, it is rapidly cooled (quenched). The holding time at the quenching temperature is, although not particularly limited, for example, 10 to 60 minutes. The quenching is achieved by, for example, water cooling. How quenching is achieved is not particularly limited. When the steel material is a steel pipe, the hollow shell may be rapidly cooled by immersing it in a water bath, or the steel pipe may be rapidly cooled by pouring or spraying cooling water to the outer surface and/or the inner surface of the steel pipe by shower cooling or mist cooling.

The steel material after quenching is further subjected to a tempering step. In the tempering step, the strength of the steel material is adjusted to be 724 to 861 MPa. For that purpose, the tempering temperature is set to more than 570° C. to the $A_{C1}$ transformation point. For the tempering step, a condition to suppress excessive precipitation of intermetallic compounds is desirable. Therefore, the lower limit of the tempering temperature is preferably 580° C., and more preferably 585° C. The upper limit of the tempering temperature is preferably 630° C., and more preferably 620° C. The martensitic stainless steel material is adjusted to have a yield strength of 724 to 861 MPa though quenching and tempering. The yield strength of the martensitic stainless steel material having the chemical composition can be adjusted to be 724 to 861 MPa by appropriately adjusting the tempering temperature depending on the chemical composition.

In the tempering step, the tempering temperature T (° C.) and the holding time t (min) at the tempering temperature satisfy Formula (3):

$$10000 \leq (T+273)\times(20+\log(t/60))\times(t/60\times(0.5Cr+2Mo)/(Cu+Ni)) \leq 40000 \quad (3)$$

where, "T" in Formula (3) is substituted by a tempering temperature (° C.), and "t" is substituted by a holding time (min) at the tempering temperature. Each element symbol in Formula (3) is substituted by a content (mass %) of the corresponding element in the steel material.

In the case of the above chemical composition satisfying Formulae (1) and (2), the precipitation of intermetallic compound is affected by the amount of heat given to the steel material during tempering. Furthermore, in the chemical composition that satisfies Formulae (1) and (2), Cr and Mo are alloying elements that constitute the intermetallic compounds. Therefore, Cr and Mo promote the formation of intermetallic compounds such as Laves phase, σ phase, χ phase and the like. On the other hand, in the chemical composition satisfying Formulae (1) and (2), Cu and Ni suppress the formation of the intermetallic compounds such as Laves phase, σ phase, χ phase, and the like. Therefore, the Cr content, Mo content, Cu content, and Ni content affect the tempering condition for suppressing the formation of intermetallic compounds.

Accordingly, in the present embodiment, tempering is performed at a tempering temperature T (° C.) and a holding time t (min), that satisfy Formula (3). In this case, in a steel material which has a chemical composition satisfying Formulae (1) and (2) and in which the volume ratio of martensite is 80% or more, it is possible to achieve that the area of intermetallic compound is 5.0 $\mu m^2$ or less, and the total area fraction of intermetallic compound and Cr oxide is 3.0% or less.

Note that supposing that F3=(T+273)×(20+log (t/60))×(t/60×(0.5Cr+2Mo)/(Cu+Ni)), if F3 is less than 10000, or F3 is more than 40000, intermetallic compound of an area of more than 5.0 $\mu m^2$ is present, or the total area fraction of intermetallic compound and Cr oxide is more than 3.0% even if the yield strength is 724 to 861 MPa in the steel material after tempering. Therefore, F3 is 10000 to 40000.

The lower limit of F3 is preferably 10300, more preferably 10500, and further preferably 10700. The upper limit of F3 is preferably 38000, more preferably 37000, further preferably 36000, and further preferably 35500.

The tempering temperature T (° C.) is the furnace temperature (° C.) of the heat treatment furnace where tempering is performed. The holding time t means the time held at the tempering temperature T. The martensitic stainless steel material of this embodiment can be produced by the production process described so far. Note that, regarding Cr oxide, if the steel material of the chemical composition which satisfies the Formulae (1) and (2) is produced by the above described production process, it is possible to achieve that the area of Cr oxide is 5.0 $\mu m^2$ or less. Then, by satisfying the above described tempering condition, it is possible to achieve that the total area fraction of intermetallic compound and Cr oxide is 3.0% or less. Moreover, regarding Ca oxide, when a steel material having the chemical composition that satisfies Formulae (1) and (2) is produced by the above described production steps, the maximum circle-equivalent diameter of Ca oxide will become 9.5 μm or less.

Moreover, the martensitic stainless steel material of the present embodiment will not be limited to the above described production method. The production method of the martensitic stainless steel material of the present embodiment will not be particularly limited on conditions that the chemical composition satisfies Formulae (1) and (2), a yield strength is 724 to 861 MPa, the volume ratio of martensite in the structure is 80% or more, the size of each intermetallic compound and each Cr oxide in steel material is 5.0 $\mu m^2$ or less, the total area fraction of intermetallic compound and Cr oxide is 3.0% or less, and the maximum circle-equivalent diameter of Ca oxide in the steel material is 9.5 μm or less.

Examples

Molten steels having the chemical compositions shown in Table 1 were produced.

TABLE 1

| Steel | Chemical composition (in mass %, with the balance Fe and impurities) | | | | | | | | | | | | | | | | | | |
|---|---|---|---|---|---|---|---|---|---|---|---|---|---|---|---|---|---|---|---|
| type | C | Si | Mn | P | S | Al | N | Ni | Cr | Cu | Mo | V | Ti | Co | Ca | O | W | F1 | F2 |
| A | 0.011 | 0.22 | 0.41 | 0.021 | 0.001 | 0.020 | 0.0024 | 5.98 | 12.08 | 1.96 | 2.55 | 0.05 | 0.086 | 0.060 | 0.0009 | 0.0040 | — | 12.1 | 6.4 |
| B | 0.011 | 0.24 | 0.41 | 0.021 | 0.001 | 0.037 | 0.0017 | 5.98 | 12.75 | 2.03 | 2.51 | 0.05 | 0.098 | 0.060 | 0.0020 | 0.0030 | — | 12.9 | 7.7 |
| C | 0.013 | 0.20 | 0.20 | 0.010 | 0.002 | 0.044 | 0.0033 | 6.50 | 13.10 | 3.05 | 2.35 | 0.03 | 0.121 | 0.160 | 0.0015 | 0.0024 | — | 14.2 | 7.4 |
| D | 0.010 | 0.25 | 0.35 | 0.016 | 0.003 | 0.048 | 0.0021 | 6.20 | 13.05 | 2.55 | 2.41 | 0.04 | 0.082 | 0.260 | 0.0010 | 0.0046 | — | 13.7 | 6.8 |
| E | 0.017 | 0.20 | 0.38 | 0.017 | 0.002 | 0.035 | 0.0033 | 6.31 | 12.52 | 2.56 | 3.01 | 0.06 | 0.133 | 0.250 | 0.0017 | 0.0025 | 1.20 | 14.2 | 6.6 |
| F | 0.011 | 0.31 | 0.26 | 0.016 | 0.004 | 0.036 | 0.0037 | 6.01 | 12.54 | 2.03 | 2.65 | 0.05 | 0.098 | 0.260 | — | 0.0034 | 0.50 | 12.9 | 6.7 |
| G | 0.009 | 0.32 | 0.29 | 0.030 | 0.003 | 0.036 | 0.0034 | 6.50 | 12.60 | 2.00 | 3.60 | 0.06 | 0.088 | 0.180 | 0.0005 | 0.0039 | 0.40 | 14.1 | 7.1 |
| H | 0.009 | 0.28 | 0.36 | 0.028 | 0.002 | 0.021 | 0.0037 | 6.21 | 13.30 | 2.80 | 2.10 | 0.06 | 0.113 | 0.290 | 0.0040 | 0.0020 | 1.30 | 13.8 | 8.9 |
| I | 0.010 | 0.26 | 0.30 | 0.024 | 0.002 | 0.025 | 0.0030 | 6.30 | 12.30 | 2.60 | 3.05 | 0.04 | 0.090 | 0.120 | 0.0030 | 0.0060 | 0.20 | 14.2 | 6.9 |

TABLE 1-continued

| Steel type | Chemical composition (in mass %, with the balance Fe and impurities) C | Si | Mn | P | S | Al | N | Ni | Cr | Cu | Mo | V | Ti | Co | Ca | O | W | F1 | F2 |
|---|---|---|---|---|---|---|---|---|---|---|---|---|---|---|---|---|---|---|---|
| J | 0.011 | 0.22 | 0.40 | 0.021 | 0.003 | 0.022 | 0.0039 | 5.00 | 13.20 | 2.30 | 2.90 | 0.06 | 0.096 | 0.210 | 0.0012 | 0.0032 | 0.30 | 16.1 | 6.4 |
| K | 0.013 | 0.33 | 0.24 | 0.023 | 0.004 | 0.026 | 0.0023 | 6.21 | 12.02 | 1.80 | 1.90 | 0.04 | 0.107 | 0.300 | 0.0024 | 0.0048 | 0.10 | 10.1 | 7.0 |
| L | 0.011 | 0.29 | 0.21 | 0.017 | 0.003 | 0.030 | 0.0050 | 5.80 | 11.90 | 2.60 | 2.90 | 0.05 | 0.091 | 0.280 | 0.0015 | 0.0011 | 0.70 | 14.2 | 5.7 |
| M | 0.019 | 0.26 | 0.56 | 0.028 | 0.003 | 0.036 | 0.0043 | 5.00 | 12.40 | 3.00 | 2.70 | 0.04 | 0.166 | 0.160 | 0.0014 | 0.0033 | — | 16.3 | 7.1 |
| N | 0.018 | 0.33 | 0.51 | 0.010 | 0.003 | 0.022 | 0.0032 | 5.40 | 11.50 | 3.50 | 2.00 | 0.06 | 0.154 | 0.110 | 0.0014 | 0.0017 | 0.50 | 14.4 | 7.3 |
| O | 0.012 | 0.34 | 0.36 | 0.017 | 0.002 | 0.048 | 0.0041 | 6.30 | 12.55 | 3.30 | 2.00 | 0.04 | 0.122 | 0.250 | 0.0013 | 0.0046 | 0.20 | 13.7 | 7.6 |
| P | 0.014 | 0.21 | 0.33 | 0.021 | 0.003 | 0.029 | 0.0023 | 5.21 | 13.21 | 2.86 | 0.88 | 0.04 | 0.106 | 0.280 | 0.0013 | 0.0017 | — | 12.9 | 6.5 |
| Q | 0.013 | 0.31 | 0.28 | 0.014 | 0.003 | 0.046 | 0.0037 | 6.90 | 12.19 | 2.03 | 2.49 | 0.04 | 0.115 | 0.220 | 0.0015 | 0.0027 | 0.60 | 10.9 | 6.9 |
| R | 0.012 | 0.22 | 0.30 | 0.022 | 0.002 | 0.022 | 0.0031 | 5.40 | 12.85 | 1.70 | 2.60 | 0.04 | 0.107 | 0.120 | 0.0024 | 0.0044 | 1.30 | 13.4 | 7.1 |

The molten steel was melted by a 50 kg vacuum furnace to produce ingots by an ingot-making process. Each ingot was heated at 1250° C. for 3 hours. The ingot after heating was subjected to hot forging to produce a block. The block after hot forging was held at 1230° C. for 15 minutes, and was subjected to hot rolling to produce a plate material having a thickness of 13 mm.

The plate material was subjected to quenching. The quenching temperature (° C.) at quenching and the holding time (min) at the quenching temperature were as listed in Table 2. For every test number, water cooling was used for rapid cooling (quenching) after elapse of the holding time. The plate material after quenching was subjected to tempering. The tempering temperature (° C.) at tempering, the holding time (min) at tempering temperature, and F3 value were as shown in Table 2.

| Test No. | Steel type | Content (mass %) Cr | Mo | Cu | Ni | F1 | F2 | Quenching step: Quenching temperature (° C.) | Holding time (min) | Tempering step: Tempering temperature (° C.) | Holding time (min) |
|---|---|---|---|---|---|---|---|---|---|---|---|
| 1 | A | 12.08 | 2.55 | 1.96 | 5.98 | 12.1 | 6.4 | 910 | 15 | 600 | 30 |
| 2 | B | 12.75 | 2.51 | 2.03 | 5.98 | 12.9 | 7.7 | 910 | 15 | 600 | 30 |
| 3 | C | 13.10 | 2.35 | 3.05 | 6.50 | 14.1 | 7.4 | 910 | 15 | 615 | 30 |
| 4 | D | 13.05 | 2.41 | 2.55 | 6.20 | 13.7 | 6.8 | 950 | 15 | 610 | 30 |
| 5 | E | 12.52 | 3.01 | 2.56 | 6.31 | 14.2 | 6.6 | 950 | 15 | 610 | 45 |
| 6 | F | 12.54 | 2.65 | 2.03 | 6.01 | 12.9 | 6.7 | 910 | 15 | 610 | 40 |
| 7 | G | 12.60 | 3.60 | 2.00 | 6.50 | 14.1 | 7.1 | 950 | 15 | 600 | 30 |
| 8 | H | 13.30 | 2.10 | 2.80 | 6.21 | 13.8 | 8.9 | 950 | 15 | 600 | 30 |
| 9 | I | 12.30 | 3.05 | 2.60 | 6.30 | 14.2 | 6.9 | 950 | 15 | 600 | 30 |
| 10 | J | 13.20 | 2.90 | 2.30 | 5.00 | 16.1 | 6.4 | 910 | 15 | 585 | 40 |
| 11 | K | 12.02 | 1.90 | 1.80 | 6.21 | 10.0 | 7.0 | 910 | 15 | 585 | 40 |
| 12 | L | 11.90 | 2.90 | 2.60 | 5.80 | 14.2 | 5.7 | 910 | 15 | 600 | 30 |
| 13 | M | 12.40 | 2.70 | 3.00 | 5.00 | 16.3 | 7.1 | 900 | 15 | 600 | 30 |
| 14 | N | 11.50 | 2.00 | 3.50 | 5.40 | 14.4 | 7.3 | 900 | 20 | 585 | 45 |
| 15 | O | 12.55 | 2.00 | 3.30 | 6.30 | 13.7 | 7.6 | 900 | 20 | 585 | 45 |
| 16 | P | 13.21 | 0.88 | 2.86 | 5.21 | 12.9 | 6.5 | 900 | 20 | 585 | 45 |
| 17 | Q | 12.19 | 2.49 | 2.03 | 6.90 | 10.9 | 6.9 | 900 | 20 | 585 | 45 |
| 18 | R | 12.85 | 2.60 | 1.70 | 5.40 | 13.4 | 7.1 | 900 | 20 | 585 | 45 |
| 19 | A | 12.08 | 2.55 | 1.96 | 5.98 | 12.1 | 6.4 | 900 | 20 | 560 | 30 |
| 20 | A | 12.08 | 2.55 | 1.96 | 5.98 | 12.1 | 6.4 | 910 | 15 | 580 | 100 |
| 21 | A | 12.08 | 2.55 | 1.96 | 5.98 | 12.1 | 6.4 | 910 | 15 | 630 | 20 |
| 22 | C | 13.10 | 2.35 | 3.05 | 6.50 | 14.1 | 7.4 | 910 | 15 | 590 | 30 |

| Test No. | F3 | volume ratio of martensite (%) | Structure | RA (%) | MA ($\mu m^2$) | Maximum diameter of Ca containing oxide (μm) | YS (MPa) | SSC resistance | Gleeble test |
|---|---|---|---|---|---|---|---|---|---|
| 1 | 12064 | 83 | M | 0.4 | 4.9 | 2.1 | 812 | E | 76 |
| 2 | 12232 | 88 | M | 0.7 | 2.0 | 8.5 | 832 | E | 78 |
| 3 | 10303 | 85 | M | 1.0 | 1.3 | 6.3 | 852 | E | 79 |
| 4 | 11276 | 85 | M | 0.7 | 2.7 | 5.1 | 847 | E | 78 |
| 5 | 18222 | 83 | M | 1.6 | 2.8 | 5.8 | 773 | E | 78 |
| 6 | 16793 | 88 | M | 1.3 | 3.2 | 1.0 | 801 | E | 72 |
| 7 | 13657 | 80 | M | 1.1 | 3.3 | 1.7 | 762 | E | 71 |
| 8 | 10355 | 85 | M | 0.9 | 2.1 | 12.1 | 855 | B | 81 |
| 9 | 11835 | 87 | M | 0.9 | 2.1 | 9.9 | 824 | B | 77 |
| 10 | 19261 | 87 | M | 3.7 | 6.2 | 6.4 | 852 | B | 78 |
| 11 | 13887 | 84 | M | 2.1 | 1.0 | 7.3 | 790 | B | 79 |
| 12 | 12028 | 82 | M | 0.6 | 4.5 | 4.0 | 819 | B | 79 |
| 13 | 12468 | 85 | M | 3.2 | 6.6 | 1.6 | 770 | B | 82 |
| 14 | 14011 | 83 | M | 3.8 | 5.1 | 3.5 | 796 | B | 78 |
| 15 | 13689 | 88 | M | 2.1 | 3.1 | 4.6 | 805 | E | 76 |
| 16 | 13257 | 86 | M | 0.5 | 2.0 | 7.4 | 858 | B | 75 |

-continued

| | | | | | | | | | |
|---|---|---|---|---|---|---|---|---|---|
| 17 | 15862 | 84 | M | 2.3 | 3.3 | 6.6 | 763 | B | 78 |
| 18 | 20941 | 87 | M | 1.2 | 1.4 | 9.1 | 820 | B | 77 |
| 19 | 11511 | 91 | M | 3.7 | 2.8 | 3.0 | 843 | B | 77 |
| 20 | 40335 | 81 | M | 4.0 | 6.7 | 3.1 | 759 | B | 79 |
| 21 | 8245 | 82 | M | 3.1 | 2.2 | 3.6 | 847 | B | 82 |
| 22 | 10013 | 83 | M | 0.8 | 1.8 | 7.1 | 872 | B | 77 |

Quenching and tempering were performed to adjust the yield strength YS to be 724 to 861 MPa. By the production method described so far, martensitic stainless steel materials were produced.

[Evaluation Test]

[Measurement Test of Volume Ratio of Martensite]

A test specimen of 15 mm×15 mm×thickness 2 mm was collected from the central position of the thickness of the plate material of each test number. By using the obtained test specimen, X-ray diffraction intensity of each of the (200) plane of α phase (ferrite and martensite), the (211) plane of α phase, the (200) plane of γ phase (retained austenite), the (220) plane of γ phase, the (311) plane of γ phase was measured to calculate an integrated intensity of each plane. In the measurement of the X-ray diffraction intensity, the target of the X-ray diffraction apparatus was Mo (MoKα ray), and the output was 50 kV-40 mA. After calculation, the volume ratio Vγ (%) of retained austenite was calculated by using Formula (I) for each combination of each plane of α phase and each plane of γ phase (2×3=6 pairs). Then, an average value of volume ratios Vγ of retained austenite of the 6 pairs was defined as the volume ratio (%) of retained austenite.

$$V\gamma=100/\{1+(I\alpha\times R\gamma)/(I\gamma\times R\alpha)\} \quad \text{(I)}$$

where, Iα is an integrated intensity of a phase. Rα is a crystallographic theoretical calculation value of α phase. Iγ is the integrated intensity of γ phase. Rγ is a crystallographic theoretical calculation value of γ phase. In the present description, it was supposed that Rα in the (200) plane of α phase be 15.9, Rα in the (211) plane of α phase be 29.2, Rγ in the (200) plane of γ phase be 35.5, Rγ in the (220) plane of γ phase be 20.8, and Rγ in the (311) plane of γ phase be 21.8.

Using the volume ratio (%) of retained austenite obtained by the X-ray diffraction method, the volume ratio of martensite of the microstructure of the martensitic stainless steel material was determined by the following Formula.

Volume ratio of martensite=100−volume ratio of retained austenite (%)

The calculated volume ratio of martensite is shown in Table 2. When the calculated volume ratio of martensite was 80% or more, it was judged that a structure mainly composed of martensite was obtained (indicated by "M" in "Structure" column in Table 2).

[Area Measurement Test of Intermetallic Compound and Cr Oxide, and Total Area Fraction Measurement Test of Intermetallic Compound and Cr Oxide]

A test specimen was collected from a central position of the thickness of the plate material of each test number. One of the test specimen was collected from a front end part (TOP part) of the plate material in the longitudinal direction, and another was collected from a rear end part (BOTTOM part). The front end part meant a section at the front end when the steel material was divided into ten equal sections in the longitudinal direction, and the rear end part meant a section at the rear end.

From the surface of the collected test specimen, an extraction replica film were prepared based on the extraction replica method. Specifically, the surface of the test specimen was electropolished. The surface of the test specimen after the electropolishing was etched using Vilella's reagent (an ethanol solution containing 1 to 5 g of hydrochloric acid and 1 to 5 g of picric acid). Thereby, precipitates and inclusions were exposed from the surface. A part of the surface after etching was covered with an extraction replica film. The test specimen the part of the surface of which was covered with the extraction replica film was immersed in a bromine methanol solution (bromomethanol) to dissolve the test specimen, thereby causing the extraction replica film to be peeled off from the test specimen. The peeled extraction replica film had a disc shape having a diameter of 3 mm. Using a TEM (transmission electron microscope), an arbitrary region of 10 $\mu m^2$ was observed at four places (4 fields of view) at a magnification of 20000 times in each extraction replica film. In one steel material, regions of eight places (hereinafter referred as observation regions) were observed.

Element concentration analysis (EDS point analysis) using EDS was conducted for precipitates or inclusions confirmed by the backscattered electron image of each observation region. Intermetallic compounds (the Laves phase, the sigma phase (σ phase), and the chi phase (χ phase)) and Cr oxides were identified based on the element concentration obtained from each precipitate or inclusion by the EDS point analysis. Individual areas ($\mu m^2$) of the identified intermetallic compounds and Cr oxides are determined. The largest area was defined as the largest area MA ($\mu m^2$) among the individual areas of the identified intermetallic compounds and Cr oxides. The total of the areas of intermetallic compound and the area of the Cr oxide was taken as the total area ($\mu m^2$) of the intermetallic compound and the Cr oxide. The ratio of the total area of the intermetallic compound and the Cr oxide to the total area (80 $\mu m^2$) of the entire observation region was defined as a total area fraction RA (%) of intermetallic compound and Cr oxide. If the largest area MA ($\mu m^2$) was more than 5.0 $\mu m^2$, it was judged that a desired microstructure was not obtained. Moreover, when the total area fraction RA was more than 3.0% as well, it was judged that a desired microstructure was not obtained. On the other hand, when the largest area MA was 5.0 $\mu m^2$ or less, and the total area fraction RA was 3.0% or less, it was judged that a desired microstructure was obtained. The "RA (%)" column in Table 2 shows the total area fraction RA (%). The "MA ($\mu m^2$)" column in Table 2 shows the largest area MA ($\mu m^2$).

[Measurement Test of Circle-Equivalent Diameter of Ca Oxide]

Test specimens were collected from central positions of thickness of the plate material of each test number. One of the test specimens was collected from a front end part (TOP part) of the plate material in the longitudinal direction, and another was collected from a rear end pan (BOTTOM part). The front end part meant a section at the front end when the steel material was divided into ten equal sections in the longitudinal direction, and the rear end part meant a section at the rear end.

The collected test specimen was embedded in resin, and the surface (observation surface) of the test specimen was polished. The surface (observation surface) of the test specimen to be polished was a surface corresponding to a cross section perpendicular to the longitudinal direction (axial direction) of the plate material. After the observation surface of the test specimen embedded in resin was polished, element concentration analysis (EDS point analysis) was performed in 5 fields of view (5 fields of view in the TOP part, 5 fields of view in the BOTTOM part, and 10 fields of view in total) on the observation surface of each test specimen. Based on the element concentration obtained from each precipitate or inclusion by the EDS point analysis, Ca oxide in each visual field was identified. Specifically, in the obtained element concentration, any inclusion in which the Ca content was 25.0% or more in mass %, the O content was 20.0% or more in mass %, and the Si content was 10.0% or less in mass % was identified as Ca oxide. Note that the area of each field of view was 10 $\mu m^2$ (100 in total).

The area of the identified Ca oxide was determined, and a circle-equivalent diameter (μm) of the Ca oxide was determined. Among the determined circle-equivalent diameters, a maximum circle-equivalent diameter was defined as a maximum circle-equivalent diameter (μm) of Ca oxide.

[Tensile Test]

Tensile test specimens were collected from a central position of the thickness of the plate material of each test number. The tensile test specimen was a round bar test specimen which had a parallel portion of a diameter of 8.9 mm, and a length of 35.6 mm. The longitudinal direction of the parallel portion of this test specimen was the rolling direction of the plate material. Using this test specimen, a tensile test was conducted at normal temperature (25° C.) in accordance with ASTM E8/E8M to determine the yield strength YS (MPa). The yield strength YS was 0.2% off-set proof stress. Obtained yield strength YS is shown in Table 2.

[SSC Resistance Evaluation Test]

A round bar test specimen having a parallel portion of a diameter of 6.3 mm and a length of 25.4 mm was collected from a central position of the thickness of the plate material of each test number. The longitudinal direction of the round bar test specimen corresponded to the longitudinal direction of the plate material. Using the round bar test specimen, a constant load test of NACE TM0177 Method A was conducted in a test solution containing hydrogen sulfide. Specifically, the test solution was prepared by passing $CO_2$ gas of 1 atm into an aqueous solution containing 5 wt % of NaCl and 0.4 g/L of $CH_3COONa$ and adding $CH_3COOH$ to adjust it to have a pH of 3.5. Applied stress to the round bar test specimen during testing was 90% of actual yield stress. The test specimen subjected to the aforementioned applied stress was immersed for 720 hours in the aqueous solution, in which a mixed gas of 0.1 atm of $H_2S$ gas and 0.9 atm of $CO_2$ was saturated. The test temperature was a normal temperature (24±3° C.).

After the test, the surface of the parallel portion of the round bar test specimen was visually observed (by use of a magnifying glass at 10 magnification). The symbol "E (Excellent)" in the "SSC resistance" column in Table 2 indicates that no crack was observed, and "B (Bad)" indicates that a crack was observed.

[Gleeble Test]

A plurality of test specimens each having a diameter of 10 mm and a length of 130 mm were cut out from a central position of the thickness of the plate material of each test number. The center axis of the test specimen corresponded to the central position of the thickness of the plate material. By using a high frequency induction heating furnace, the test specimen was heated from the room temperature to 1200° C. in 60 seconds, and thereafter further heated from 1200° C. to 1250° C. in 30 seconds. Thereafter, the test specimen was cooled to 1000° C. at a cooling rate of 100° C./min. After the test specimen was cooled to 1000° C., tensile test was conducted on the test specimen at 1000° C. at a strain rate of 10 $sec^{-1}$, to cause the test specimen to be broken off, to determine a reduction ratio (%). When the reduction ratio is 73% or more, it was judged that the steel material of that test number was excellent in hot workability.

[Test Results]

Referring to Table 2, the chemical compositions of Test Nos. 1 to 5, and 15 were appropriate and satisfied Formulae (1) and (2). Further, the production conditions thereof were appropriate. For that reason, in the microstructure, the volume ratio of martensite was 80% or more, the area of each intermetallic compound and each Cr oxide in the structure was 5.0 $\mu m^2$ or less, and the total area fraction of intermetallic compound and Cr oxide in the structure was 3.0% or less. Further, the maximum circle-equivalent diameter of Ca oxide in steel was 9.5 μm or less. As a result of that, the results showed excellent SSC resistance even in an environment in which $H_2S$ was 0.1 atm. Further, the reduction ratio in Gleeble test was 73% or more, thus showing excellent hot workability On the other hand, in Test No. 6, Ca was not contained. Further, in Test No. 7, the Ca content was too low. For that reason, in these test numbers, the reduction ratio in Gleeble test was less than 73%, thus exhibiting low hot workability.

In Test No. 8, the Ca content was too high. Further, in Test No. 9, the O content was too high. For those reasons, the maximum circle-equivalent diameter of Ca oxide in steel was more than 9.5 μm. For that reason, SSC resistance was low.

In Test Nos. 10, 13, and 14, the F1 value was more than the upper limit of Formula (1). For that reason, SSC resistance deteriorated. Since F1 value was more than the upper limit of Formula (1), the stability of intermetallic compound was high, and intermetallic compounds precipitated during tempering, and as a result of that, solid-solved Cr, Mo, Cu around the intermetallic compound decreased locally, thus deteriorating SSC resistance.

In Test No. 11, the F1 value was less than the lower limit of Formula (1). For that reason, SSC resistance was low.

In Test No. 12, F2 did not satisfy Formula (2). For that reason, SSC resistance was low.

In Test No. 16, the Mo content was too low. For that reason, SSC resistance was low.

In Test No. 17, the Ni content was too high. For that reason, SSC resistance was low.

In Test No. 18, the Cu content was too low. For that reason, SSC resistance was low.

In Test No. 19, although the chemical composition was appropriate, the tempering temperature was too low. As a result of that, the total area fraction of intermetallic compound and Cr oxide was more than 3.0%. As a result of that, SSC resistance was low.

In Test No. 20, although the chemical composition was appropriate, F3 was more than 40000. As a result, intermetallic compound of a size of more than 5.0 $\mu m^2$ was confirmed, and the total area fraction of intermetallic compound and Cr oxide was more than 3.0%. As a result, SSC resistance was low.

In Test No. 21, although the chemical composition was appropriate, F3 was less than 10000. As a result, the total area fraction of intermetallic compound and Cr oxide was more than 3.0%. As a result, SSC resistance was low.

In Test No. 22, although the chemical composition was appropriate, the yield strength was more than 861 MPa. As a result, SSC resistance was low.

So far, embodiments of the present invention have been described. However, the embodiments are merely exemplification for practicing the present invention. Therefore, the present invention will not be limited to the embodiments, and can be practiced by appropriately modifying the embodiments within a range not departing from the spirit thereof.

What is claimed is:

1. A martensitic stainless steel material, comprising a chemical composition consisting of: in mass %, C: 0.030% or less,
Si: 1.00% or less,
Mn: 1.00% or less,
P: 0.030% or less,
S: 0.005% or less,
Al: 0.010 to 0.100%,
N: 0.0010 to 0.0100%,
Ni: 5.00 to 6.50%,
Cr: 10.00 to 13.40%,
Cu: 1.80 to 3.50%,
Mo: 1.00 to 4.00%,
V: 0.01 to 1.00%,
Ti: 0.050 to 0.300%,
Co: 0.300% or less,
Ca: 0.0006 to 0.0030%,
O: 0.0050% or less, and
W: 0 to 1.50%, with the balance being Fe and impurities, and satisfying Formulae (1) and (2), wherein a yield strength is 724 to 861 MPa, a volume ratio of martensite is 80% or more in the microstructure, an area of each intermetallic compound and each Cr oxide in the steel material is 5.0 $m^2$ or less, and a total area fraction of intermetallic compounds and Cr oxides is 3.0% or less, and a maximum circle-equivalent diameter of an oxide containing Ca is 9.5 m or less in the steel material:

$$11.5 \leq Cr+2Mo+2Cu-1.5Ni \leq 14.3 \quad (1)$$

$$Ti/(C+N) \geq 6.4 \quad (2)$$

where, each symbol of element in Formulae (1) and (2) is substituted by the content, in mass %, of the corresponding element.

2. The martensitic stainless steel material according to claim 1, wherein the chemical composition contains W: 0.10 to 1.50%.

3. The martensitic stainless steel material according to claim 1, wherein the martensitic stainless steel material is a seamless steel pipe for oil country tubular goods.

4. The martensitic stainless steel material according to claim 2, wherein the martensitic stainless steel material is a seamless steel pipe for oil country tubular goods.

* * * * *